US008646893B2

(12) United States Patent
Ramesh et al.

(10) Patent No.: US 8,646,893 B2
(45) Date of Patent: Feb. 11, 2014

(54) SYSTEM AND METHOD FOR IMPROVING TEMPERATURE UNIFORMITY OF IMAGE DRUMS

(75) Inventors: Palghat S. Ramesh, Pittsford, NY (US); Bruce Earl Thayer, Spencerport, NY (US); David A. VanKouwenberg, Avon, NY (US); Rachael L. McGrath, Churchville, NY (US); Trevor J. Snyder, Newberg, OR (US); Walter Sean Harris, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 49 days.

(21) Appl. No.: 13/527,380

(22) Filed: Jun. 19, 2012

(65) Prior Publication Data

US 2013/0335476 A1 Dec. 19, 2013

(51) Int. Cl.
*B41J 2/175* (2006.01)

(52) U.S. Cl.
USPC ..... 347/88

(58) Field of Classification Search
USPC ..... 347/19, 62, 88, 81, 102
See application file for complete search history.

(56) References Cited

U.S. PATENT DOCUMENTS

| | | | | |
|---|---|---|---|---|
| 5,561,512 | A | 10/1996 | Fukano et al. | |
| 5,787,321 | A | 7/1998 | Nishikawa et al. | |
| 5,835,830 | A | 11/1998 | Fukuda et al. | |
| 6,018,151 | A | 1/2000 | Hirst | |
| 6,185,836 | B1 | 2/2001 | Zaoralek | |
| 6,567,629 | B2 | 5/2003 | Anderson et al. | |
| 7,054,572 | B2 | 5/2006 | Baruch et al. | |
| 7,421,219 | B2 | 9/2008 | Matsuura et al. | |
| 7,609,991 | B2 | 10/2009 | Koshida | |
| 7,860,418 | B2 | 12/2010 | VanKouwenberg et al. | |
| 7,926,898 | B2 * | 4/2011 | Snyder et al. | 347/17 |
| 8,308,281 | B2 * | 11/2012 | Freitag et al. | 347/88 |
| 8,366,254 | B2 * | 2/2013 | Platt et al. | 347/88 |
| 2005/0207801 | A1 | 9/2005 | Kunii et al. | |
| 2006/0078428 | A1 | 4/2006 | Zheng | |
| 2011/0096353 | A1 | 4/2011 | Li et al. | |

* cited by examiner

*Primary Examiner* — Lamson Nguyen
(74) *Attorney, Agent, or Firm* — Maginot, Moore & Beck, LLP

(57) ABSTRACT

A printer includes an image drum temperature regulation system that helps reduce thermal gradients on the image drum surface. The image drum temperature regulation system includes a feedback controller and a feed-forward controller. The image drum temperature regulation system operates the heaters and fan of the image drum with reference to a temperature difference between actual temperature of the image drum and a temperature setpoint and to the thermal effect of ejecting an ink image onto the image drum.

26 Claims, 5 Drawing Sheets

SYSTEM AND METHOD FOR IMPROVING TEMPERATURE UNIFORMITY OF IMAGE DRUMS

TECHNICAL FIELD

This disclosure relates to imaging devices having rollers heated with multiple heaters and, more particularly, to imaging devices having image receiving members that are heated with different heaters.

BACKGROUND

Imaging devices use a variety of marking materials to generate a physical image of an electronic image. The materials include, for example, aqueous ink, melted ink, and toner. The marking material may be ejected onto or developed on an image receiving member. For example, electronic image data may be used to operate a raster to generate a latent image on a photoreceptor belt and then the latent image is developed with toner material in a development station. With aqueous ink or melted ink, a printhead ejects the melted ink onto an image receiving member, also known as an image drum. The inkjets in the printhead are operated by a printhead controller to eject ink onto the image receiving member. The printhead controller generates firing signals with reference to electronic image data to operate the inkjets.

Once the marking material is deposited onto an image receiving member, the image may be transferred or transfixed to an image media. For example, a sheet or web of image media may be moved into a nip formed between the image receiving member and a transfix or fuser roller so the image can be transferred to the image media. The movement of the image media into the nip is synchronized with the movement of the image on the image receiving member so the image is appropriately aligned with and fits within the boundaries of the image media. The pressure within the nip helps transfix or fuse the marking material onto the image media.

The image receiving member is typically heated to improve compatibility of the image receiving member with the inks deposited on the member. The image receiving member may be, for example, an anodized and etched aluminum drum or a steel drum. Within the drum, a heater reflector may be mounted axially within the drum. One or more heaters are located along the heater reflector. The heater reflector remains stationary as the drum rotates. Thus, the heaters apply heat to the inside of the drum as the drum rotates past the heaters on the reflector. The reflector helps direct the heat towards the inside surface of the drum.

Differences in temperatures of the components interacting during a print cycle cause thermal gradients to appear across the outside surface of the image drum. For example, the controller in one printer operates the heaters to maintain the temperature of the outside surface in a range of about 55 degrees Celsius, plus or minus 5 degrees Celsius. The ink that is ejected onto the print drum has a temperature of approximately 110 to approximately 120 degrees Celsius. Thus, images having areas that are densely pixilated may impart a substantial amount of heat to a portion of the print drum when several copies of such images are printed. Additionally, the drum experiences convective heat losses from the exposed surface areas of the drum as the drum rapidly spins in the air about the drum. The recording media contacting the print drum causes further heat losses on the surface of the drum. For example, paper placed in a supply tray has a temperature roughly equal to the temperature of the ambient air. As the paper is retrieved from the supply tray, it moves along a path towards the transfer nip. Typically, this path includes a media pre-heater that raises the temperature of the media. These temperatures may be approximately 40 degrees Celsius. Thus, when the media enters the transfer nip, areas of the print drum having relatively few drops of ink on them are exposed to the cooler temperature of the media. Consequently, densely pixilated areas of the print drum are likely to increase in temperature, while more sparsely covered areas are likely to lose heat to the passing media. These differences in temperatures result in thermal gradients across the print drum.

Efforts have been made to control the thermal gradients across a print drum for the purpose of maintaining the surface temperature of the print drum within the operating range. Heater control alone is sometimes ineffective because the amount of ejected ink in some images may raise the surface temperature of the print drum above the operating range even when the heater in that portion of the drum is off. In some print drums, a fan has been added at one end of a print drum to provide cooling. The print drum is open at each flat end of the drum. To best provide cooling, the fan is located outside the print drum and is oriented to blow air from the end of the drum at which the fan is located to the other end of the drum where it is exhausted. The fan is electrically coupled to the controller so the controller activates the fan in response to one of the temperature sensors detecting a temperature exceeding the operating range of the print drum. The air flow from the fan eventually cools the overheated portion of the print drum and the controller deactivates the fan.

While the fan system described above works for maintaining the temperature of the drum within an operating range, the system possesses some inefficiencies. Specifically, inefficiency arises when the surface portion of the print drum at which the air flow is exhausted has a higher temperature than the surface area near the end at which the fan is mounted. In response to the higher temperature detection, the controller activates the fan. As the cooler air enters the drum, it absorbs heat from the area near the fan that is within operating range. This cooling may result in the controller turning on the heater for that region to keep that area from falling below the operating range. Even though the air flow is heated by the region near the fan and/or the heater in that area, it is still able to cool eventually the overheated area near the drum end from which the air flow is exhausted. Nevertheless, the energy spent warming the region near the fan and the additional time required to cool the overheated area with the warmed air flow from the fan adds to the operating cost of the printer.

The above system is generally limited to image drums made of anodized aluminum because of its high thermal diffusivity. Materials with lower thermal diffusivity, such as steel, cannot be used efficiently as the temperature may increase beyond the operating temperature when ink is concentrated at a certain location on the drum. Therefore, more efficient cooling of the print drum is desired.

SUMMARY

An apparatus has been developed to regulate roller temperature in a printer. The apparatus comprises a cylindrical wall configured for rotation about a longitudinal axis, at least three temperature sensors, at least three heaters, a fan, and a controller. Each temperature sensor is configured to generate a signal corresponding to a temperature of a portion of the cylindrical wall that is different than a portion of the cylindrical wall for which the other temperature sensors generate signals. The at least three heaters are each configured to heat a portion of the cylindrical wall and the fan is configured to move air within the cylindrical wall. The controller is operatively connected to the fan, the at least three temperature sensors, and the at least three heaters, and is configured to receive the signals from the at least three temperature sensors and to operate the fan and the at least three heaters selectively and independently of one another to maintain a predetermined temperature for each portion of the cylindrical wall. The controller operates the fan and the at least three heaters with reference to the signals generated by the at least three temperature sensors and image data used to operate at least one printhead that ejects melted solid ink onto the cylindrical wall.

In another embodiment a method for controlling the temperature of an image drum has been developed. The method comprises: generating a temperature signal corresponding to a temperature for at least three portions on a cylindrical wall, each temperature signal being measured by a different temperature sensor; receiving the at least three temperature signals by a controller operatively connected to at least three heaters, each of which is configured to heat a portion of the cylindrical wall, and a fan configured to move air within the cylindrical wall; and the controller operating the fan and the at least three heaters to maintain a predetermined temperature for each portion of the cylindrical wall with reference to the signals generated by the at least three temperature sensors and image data used to operate at least one printhead that ejects melted solid ink onto the cylindrical wall.

In yet another embodiment a controller has been developed. The controller comprises a feed-forward controller and a feedback controller. The feed-forward controller is configured to receive image data from a printer and generate a first actuation vector configured with a first set of values to operate at least three heaters and a fan in an image drum in the printer to negate an effect on temperatures of at least three portions of a cylindrical wall of the image drum resulting from deposition of ink on the image drum corresponding to the image data. The feedback controller is configured to receive signals from at least three temperature sensors sensing temperatures of the at least three portions of the cylindrical wall and generate a second actuation vector configured with a second set of values to operate the at least three heaters and the fan to maintain the temperatures of the at least three portions of the cylindrical wall of the image drum near a setpoint temperature. The controller is configured to operate the fan and the at least three heaters with reference to the first actuation vector and the second actuation vector.

DETAILED DESCRIPTION

The word "printer" as used herein encompasses any apparatus, such as a digital copier, book making machine, facsimile machine, multi-function machine, and the like, that produces an image with a colorant on recording media for any purpose. Printers that form an image on an image receiving member and then transfer the image to recording media are referenced in this document as indirect printers. Indirect printers typically use intermediate transfer, transfix, or transfuse members to facilitate the transfer of the image from the image receiving member to the recording media. In general, such printing systems typically include a colorant applicator, such as a printhead, that forms an image with colorant on the image receiving member.

An indirect solid ink, or phase-change ink, printer uses inks that are solid at room temperature. The solid ink is heated to a temperature where the ink melts and the liquid ink can then be routed to the printhead and ejected onto an image receiving member. The ink remains at a sufficiently high temperature on the image receiving member that it can be transferred to the recording medium. One type of image receiving member used in an indirect phase-change ink printer is a cylindrical image drum. The image drum is hollow with the outer surface of the cylindrical wall forming an image receiving surface for ink drops. The image drum is typically formed with a metal cylindrical wall. In one embodiment, the drum is formed from anodized aluminum, although steel or other metals and similar materials can be used.

Figure 1:
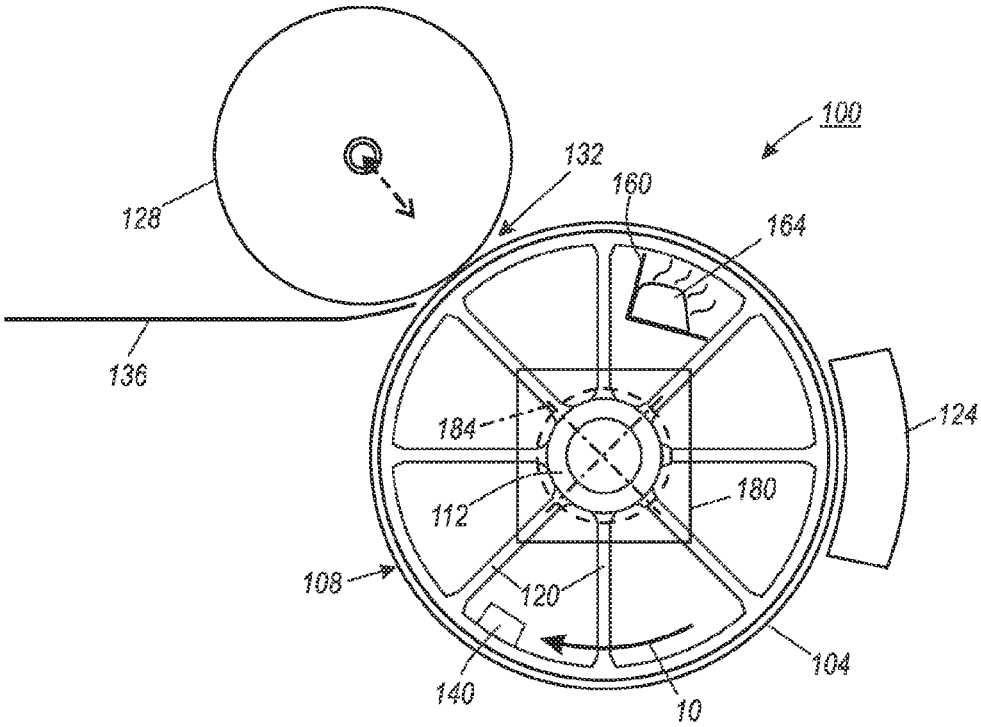
FIG. 1 is a side view of a printer showing an image drum.

FIG. 1 is a side view of a printer showing major components for forming an image and a portion of a temperature control system for an image drum. The printer includes an image drum 100 including a cylindrical wall 104 having outer surface 108, onto which melted ink is ejected by a printhead 124 as the drum rotates in direction 10. One or more revolutions of the drum 100 occur before an image is formed on the outer surface 108. A transfer or transfix roller 128 is displaceable towards and away from the drum 100 to form a nip 132 between the transfer roller 128 and the outer surface 108 in a selective manner. The nip 132 is formed in synchronization with an image on the surface 108 approaching the area between the transfer roller 128 and the image drum 100. A media path 136 supports recording media and directs media into the nip 132. Delivery of recording media to the nip 132 is also synchronized with the approach of the image on the surface 108 towards the transfer roller 128. As the media passes through the nip, the image is transferred from the image drum 100 to the media. The media then exits the nip and moves to the output tray on a media output path (not shown).

Figure 2:
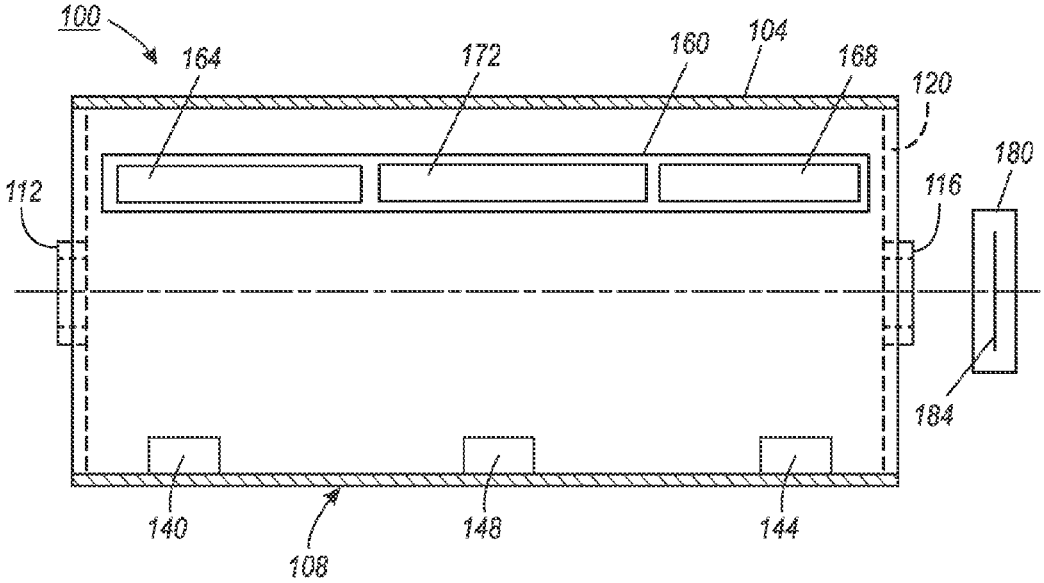
FIG. 2 is a front view of the image drum shown in FIG. 1.

As shown in FIG. 2, the image drum 100 includes a heat reflector 160 into which a first heater 164, a second heater 168, and a third heater 172 (FIG. 2) are mounted. The reflector 160 and heaters 164, 168, 172 remain fixed as the cylindrical wall 104 rotates past the heaters 164, 168, 172. The heaters 164, 168, 172 generate heat that is absorbed by the inside surface of the cylindrical wall 104 to heat the image drum 100 as it rotates past the heaters 164, 168, 172. The drum 100 further includes a first hub 112 and a second hub 116 (FIG. 2) that are centered about the longitudinal axis of the cylindrical wall 104, with one hub located on each end of the image drum 100. A fan 180 is mounted outboard of the second hub 116 and oriented to direct air flow through the drum. First 140, second 144, and third 148 temperature sensors are positioned in contact with the inside of the cylindrical wall 104 to detect the temperature of the wall 104 as it rotates. Alternatively, the first 140, second 144, and third 148 temperature sensors can be non-contact temperature sensors. In another embodiment the first 140 and second 144 temperature sensors are physical sensors, which are contact or non-contact sensors that generate an electrical signal corresponding to a sensed temperature, while the third sensor 148 is a virtual sensor, which estimates temperature using a drum temperature model, heater and fan actuation, and ink load data.

Figure 3:
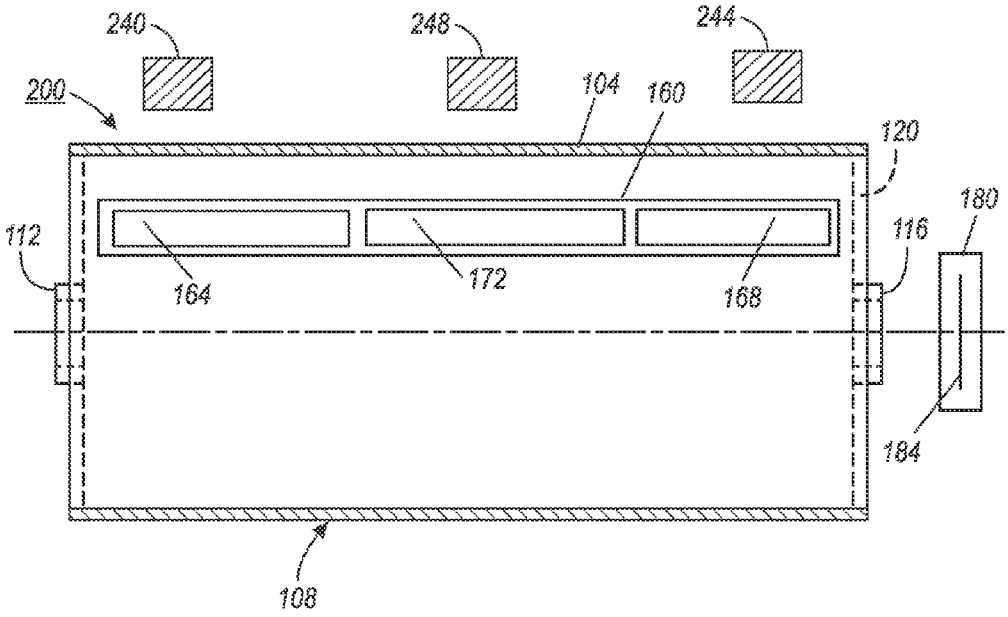
FIG. 3 is a front view of another embodiment of an image drum.

Another embodiment of an image drum 200 is depicted in FIG. 3. The image drum 200 includes a cylindrical wall 104, hubs 112, 116, spokes 120, heat reflector 160, heaters 164, 168, 172, and fan 180 arranged in a similar manner to the embodiment shown in FIG. 1 and FIG. 2. However, instead of temperature sensors that contact the drum wall being located inside the drum, temperature sensors 240, 244, 248 are positioned outside the image drum 200. These sensors are configured to sense the temperature on the surface 108 of the image drum 200 as the drum rotates without contacting the wall 104 of the drum 200. One example of a non-contact temperature sensor is an infrared temperature sensor.

In one embodiment, the drum 100 is an aluminum drum that has been anodized and etched. In other embodiments the drum is steel or another suitable material. Each end of the drum 100 is open with a hub and spokes 120 as shown in FIG. 1. The hubs 112, 116 further include a pass through for passage of electrical wires to the heaters 164, 168, 172 within the drum. Additionally, the hubs 112, 116 include a bearing at its center to enable the drum 100 to rotate within the printer. The spokes 120 extend from the hub 112 to support the cylindrical wall 104 of the drum 100, and the voids between the spokes 120 at each end of the drum 100 facilitate air flow through the drum 100.

The heaters 164, 168, 172 can be convective or radiant heaters. The fan 180 may be a muffin fan or other conventional electrical fan, and may be a DC fan or a bi-directional fan. A bi-directional fan is one that can push or pull an air flow in response to an activation signal and a direction signal. The direction of fan blade rotation in a DC fan depends upon the polarity of the DC power source applied to the fan. Thus, a DC fan can be operated to blow air in one direction or the other by controlling the polarity of the source voltage to the fan. For most typical printing applications, the fan 180 should produce air flow in the range of approximately 45-55 cubic feet per minute (CFM) of air flow, although other airflow ranges can be used depending upon the thermal parameters of a particular application. The temperature sensors 140, 144, 148 of the embodiment of FIG. 1 can be any type of contact temperature sensing device that generates an analog or digital signal indicative of a temperature of the surface on which the sensor is mounted. Such sensors include, for example, thermistors or other junction devices that predictably change in some electrical property in response to the absorption of heat. Other types of sensors include dissimilar metals that bend or move as the materials having different coefficients of temperature expansion respond to heat. The temperature sensors 240, 244, 248 of the embodiment of FIG. 3 may be any type of non-contact temperature sensing device, such as an infrared sensor.

A cross-sectional view of the drum 100 through the center of the hubs 112, 116 is shown in FIG. 2. The drum 100 has a longitudinal axis running through the center of the hubs 112, 116. The first heater 164 heats a first portion of the cylindrical wall 104, the second heater 168 heats a second portion of the cylindrical wall 104, and the third heater 172 heats a third portion of the cylindrical wall 104. The first and second portions of the cylindrical wall 104 are located at the ends of the cylindrical wall 104, while the third portion is located substantially in the center of the wall 104 along the length of the wall. The first, second, and third portions of the cylindrical wall correspond to the locations of the first 140, second 144, and third 148 temperature sensors, respectively. Additional heaters and temperature sensors can be mounted within the drum 100 if more localized area sensing and control of the drum heating is required.

In the illustrated embodiments, fan 180 is a bi-directional fan. That is, the direction of rotation for the fan blade 184 is controlled by an appropriate signal to the fan. When the blade 184 rotates in one direction, air flows from fan 180 through the drum 100 from the first hub 112 to the second hub 116. When the blade 184 rotates in the opposite direction, air flows from the second hub 116 to the first hub 112. The fan 180 is a DC fan and the polarity of the supply voltage to the fan determines the direction of fan blade rotation and the direction of the air flow through the drum 100. Thus, a bi-directional fan and DC fan provide two directions of air flow through the drum 100 with a single fan. The advantage of a bi-directional fan is that the blade of such fans is shaped so the air flow is approximately the same regardless of the direction in which the blade is turning.

Figure 4:
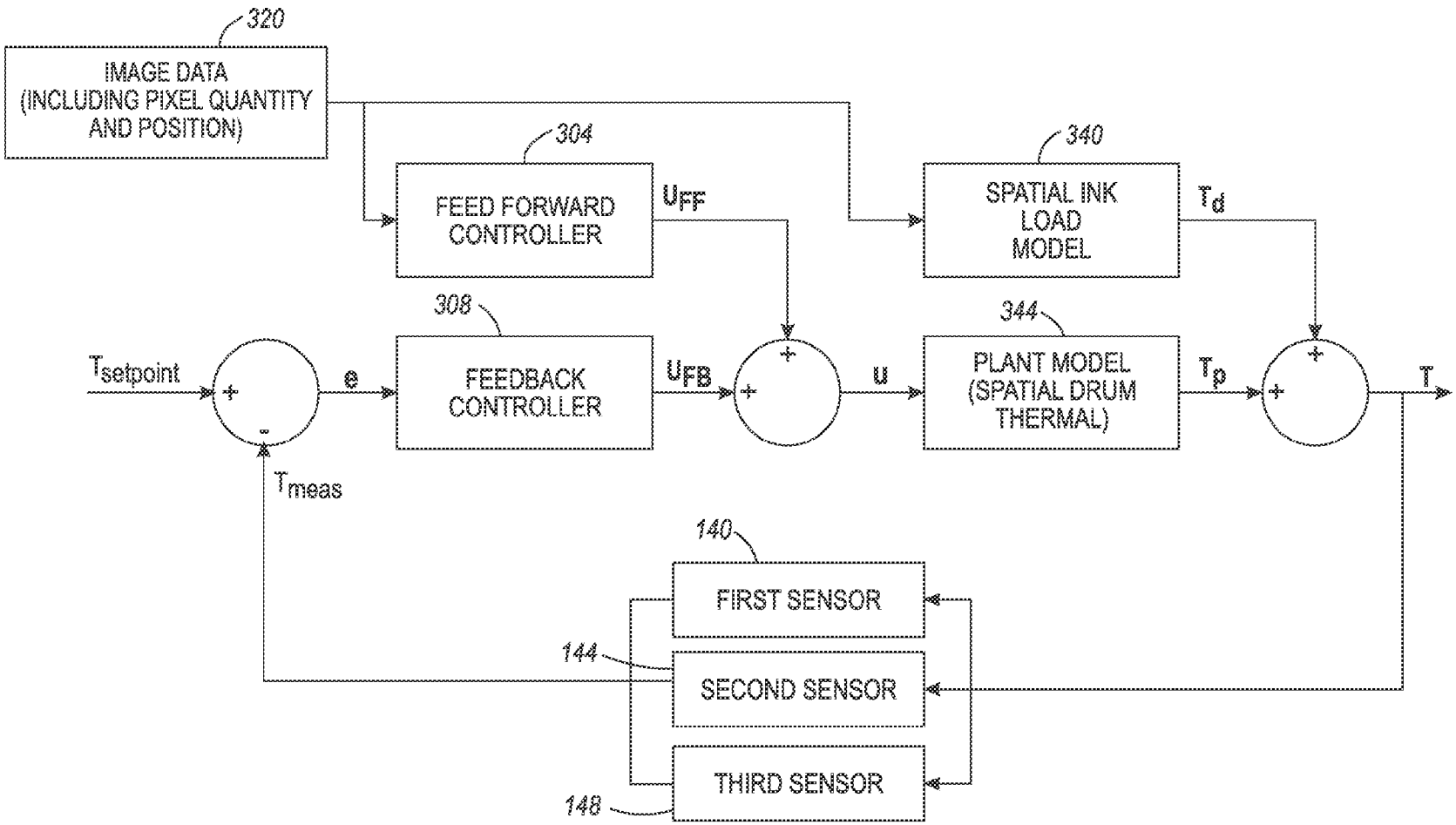
FIG. 4 is a block diagram of a controller system for the image drum shown in FIG. 1.

FIG. 4 is a block diagram of a control system 300 for the image drum. The control system 300 includes a feed-forward controller 304, a feedback controller 308, a spatial ink load model 340, and a plant model 344. Image data 320, including the position of pixels and the number of pixels to be printed, is input to a feed-forward controller 304. The feed-forward 304 controller can be implemented with general or specialized programmable processors that execute programmed instructions to operate and communicate with other components in the printer to generate a first actuation vector ($u_{FF}$). The instructions and data required for the first actuation vector generation can be stored in memory associated with the processors or controllers. The processors are configured with the programmed instructions stored in memories and with interface circuitry operatively connected to the processors. The interface components can be provided on a printed circuit card or provided as a circuit in an application specific integrated circuit ("ASIC"). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

The feed-forward controller 304 is configured to analyze the image data and output the first actuation vector corresponding to activation of any or all of the heaters 164, 168, 172 and the fan 180 to negate an increase in drum temperature caused by ink deposited onto the image drum to print the image. The feedback controller 308 receives the signals from the temperature sensors 140, 144, 148, as well as a setpoint temperature ($T_{setpoint}$). The setpoint temperature can be provided by another controller operating the printer or it can be retrieved from a memory operatively connected to the feedback controller. The feedback controller 308 calculates a second actuation vector ($u_{FB}$) from the difference between the setpoint temperature and the sensed temperatures (e). The second actuation vector is calculated to correct for differences between the temperatures measured by the temperature sensors 140, 144, 148 used in the calculation and the setpoint temperature. The two actuation vectors calculated by the controllers 304, 308 are combined to produce a final actuation vector (u), which determines the control parameters that are used to regulate the electrical power delivered to each heater 164, 168, 172, and the control signals that are generated and delivered to the fan motor to regulate the rotational speed and flow direction of the fan 180.

The spatial ink load model 340 and the plant model 344 are implemented with one or more processors that execute programmed instructions stored in a memory operatively connected to the processor(s). Alternatively, another processor can implement the two models by executing programmed instructions stored in another memory within the printer. The execution of the programmed instructions for the two models enables identification of the response of the image drum to the next ink image corresponding to the image data 320 ($T_d$) as well as the response of the temperature regulation system for the image drum to the final actuation vector ($T_p$). These responses are added together to identify an expected temperature for the image drum (T), which should correspond to the temperature setpoint.

In more detail, the controller implementing the plant model 344 receives the final actuation vector and calculates a plant temperature difference. This plant temperature difference of the image drum occurs in response to the operation of the heaters 164, 168, 172 and fan in accordance with the final actuation vector. The spatial ink load model 340 calculates a predicted ink load temperature change caused by an amount of ink ejected onto the image drum corresponding to the image data 320. The predicted ink load temperature change and the plant temperature difference should be nearly equal, indicating that operating the heaters 164, 168, 172 and the fan 180 in accordance with the final actuation vector is predicted to keep the temperature of the drum near the setpoint temperature.

Figure 5:
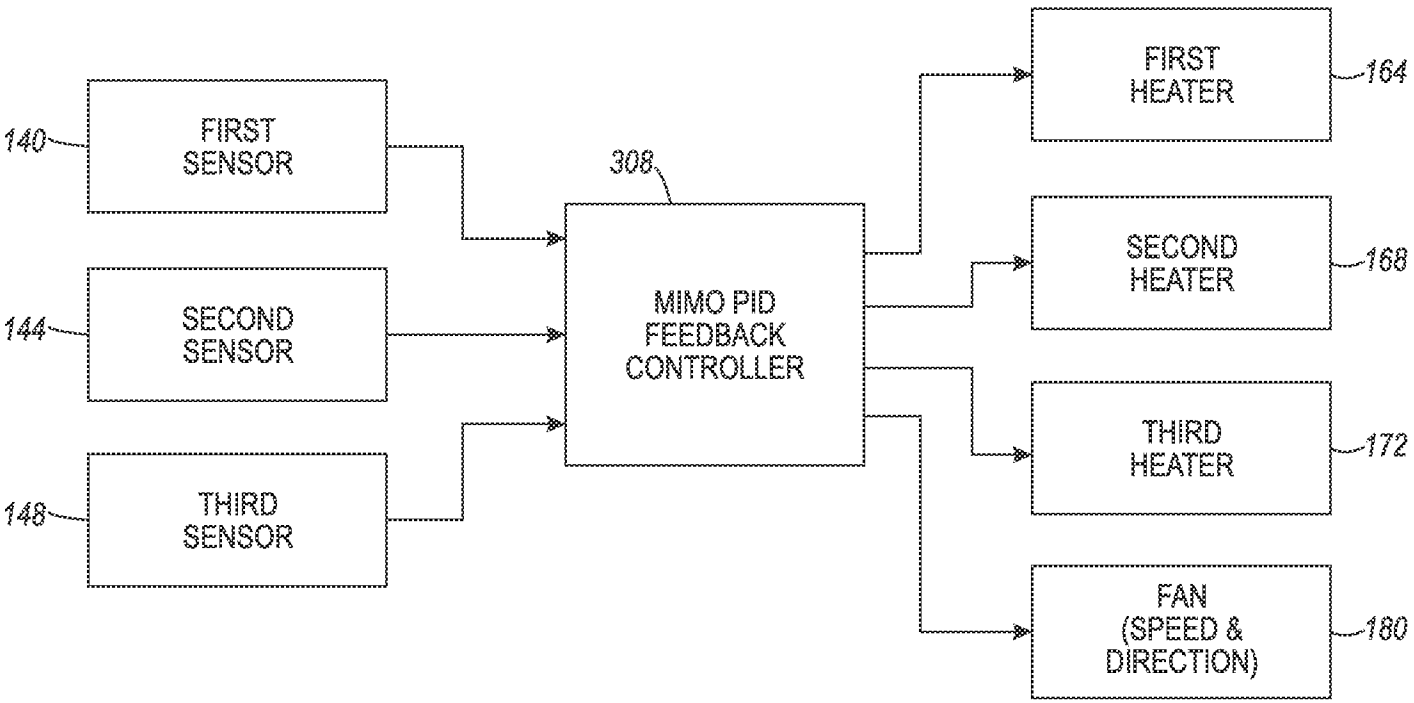
FIG. 5 is a block diagram of a controller system for the image drum of FIG. 1.

A block diagram for the feedback controller is shown in FIG. 5. The feedback controller 308 is a multiple-input multiple-output ("MIMO") proportional integral derivative ("PID") controller. This PID controller can be a general purpose microprocessor that executes programmed instructions stored in a memory or it can be an ASIC. Alternatively, the feedback controller 308 can be implemented with discrete electronic components or with a combination of programmable components and discrete components. The signals from sensors 140, 144, 148 can be analog signals that are digitized by an A/D converter interfaced to the feedback controller 308. The feedback controller 308 receives as inputs temperature values from the temperature sensors 140, 144, 148. The PID feedback controller 308 is configured to analyze the input data and determine a feedback actuation vector corresponding to operation of any or all of the heaters 164, 168, 172 and fan 180 that would, in the absence of outside variables such as ink loading, keep the temperature of the drum as near as possible to the setpoint temperature.

Figure 6:
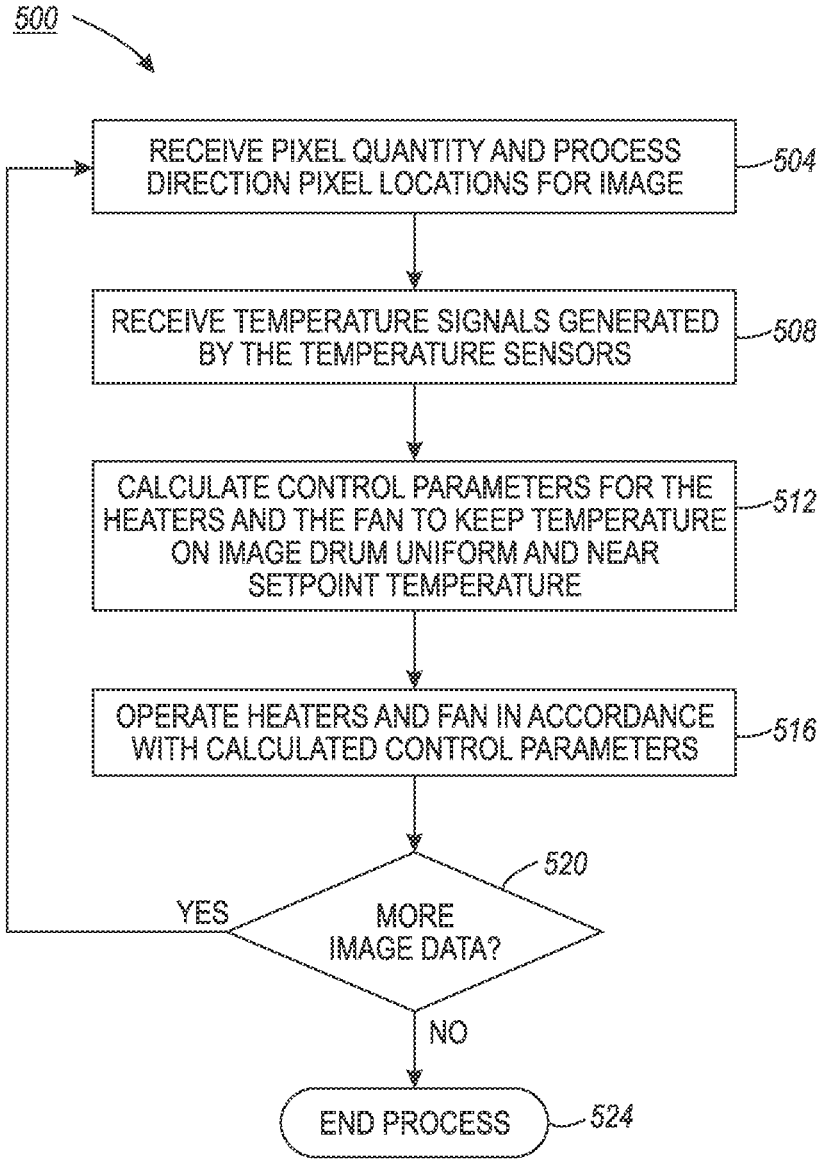
FIG. 6 is a flow diagram of a method of improving temperature uniformity of an image drum.

FIG. 6 depicts a flow diagram of a process 500 for controlling the temperature of an image drum. The processor(s) of the feedback controller 308, the feed-forward controller 304, and the processor(s) for the models 340, 344 execute programmed instructions stored in one or more memories operatively connected to the processors to operate components in the printer and perform the process. The controller implementing the process receives image data from the printer corresponding to the pixel quantity and pixel locations in the process direction for an upcoming print (block 504). The controller also receives the temperature signals generated by the temperature sensors (block 508) for each portion of the image drum. The controller calculates an actuation vector corresponding to control parameters for the heaters and fan. The actuation vector includes the electrical power delivered to each heater and the speed and direction of the fan to keep the drum temperature uniform and near the setpoint temperature (block 512). The computation of the actuation vector is done as described above with reference to the feed-forward controller and feedback controller. The controller then delivers power to the heaters and signals corresponding to the fan speed and direction in accordance with the calculation (block 516). Next, the controller determines if there is more image data corresponding to additional pages for the printer to print (block 520). If additional image data is ready to process, the process continues (block 504). If no more image data is ready to process, then the process terminates (block 524).

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed:

1. An apparatus comprising:

a cylindrical wall configured for rotation about a longitudinal axis;

at least three temperature sensors, each temperature sensor being configured to generate a signal corresponding to a temperature of a portion of the cylindrical wall that is different than a portion of the cylindrical wall for which the other temperature sensors generate signals;

at least three heaters, each heater being configured to heat a portion of the cylindrical wall;

a fan configured to move air within the cylindrical wall; and a controller operatively connected to the fan, the at least three temperature sensors, and the at least three heaters, the controller being configured to receive the signals from the at least three temperature sensors and to operate the fan and the at least three heaters selectively and independently of one another to maintain a predetermined temperature for each portion of the cylindrical wall with reference to the signals generated by the at least three temperature sensors and image data used to operate at least one printhead that ejects melted solid ink onto the cylindrical wall.

2. The apparatus of claim 1 wherein each temperature sensor is a contact temperature sensor.

3. The apparatus of claim 2 wherein each temperature sensor is positioned to detect a temperature of an inner surface of the cylindrical wall.

4. The apparatus of claim 2 wherein the contact temperature sensors are thermistors.

5. The apparatus of claim 1 wherein each temperature sensor is a non-contact temperature sensor.

6. The apparatus of claim 5 wherein each temperature sensor is positioned to detect a temperature of an outer surface of the cylindrical wall.

7. The apparatus of claim 5 wherein the non-contact temperature sensors are infrared temperature sensors.

8. The apparatus of claim 1 wherein at least one temperature sensor in the at least three temperature sensors is a virtual temperature sensor configured to generate a signal estimating a temperature of the corresponding portion of the cylindrical wall with reference to signals generated by the other temperature sensors in the at least three temperature sensors, operation of the fan and the at least three heaters, and the image data.

9. The apparatus of claim 1 wherein the fan is a bi-directional fan; and the controller is further configured to operate the fan to move air in one of two directions selectively.

10. The apparatus of claim 1, the controller being further configured to operate the at least three heaters and the fan with reference to a number of pixels in the image data.

11. The apparatus of claim 1, the controller being further configured to operate the at least three heaters and the fan with reference to positions of pixels in the image data.

12. The apparatus of claim 11, the controller being further configured to operate the at least three heaters and the fan with reference to positions of the pixels in the image data in the process direction.

13. The apparatus of claim 1, the controller being further configured to operate the at least three heaters and the fan with reference to a number of pixels in the image data and positions of the pixels in the image data.

14. The apparatus of claim 13, the controller being further configured to operate the at least three heaters and the fan with reference to the positions of the pixels in the image data in a process direction.

15. The apparatus of claim 1, each portion of the cylindrical wall for which each temperature sensor in the at least three temperature sensors generates signals defining a circumferential band that does not overlap with a circumferential band for which the other temperature sensors generate signals.

16. The apparatus of claim 1, the controller further comprising:

a feed-forward controller configured to generate a first actuation vector corresponding to operating the at least three heaters and fan to negate an effect on the temperatures of the at least three portions of the cylindrical wall resulting from deposition of ink on the image drum corresponding to the image data; and a feedback controller configured to receive the signals from the at least three temperature sensors and generate a second actuation vector corresponding to operating the at least three heaters and fan to maintain the temperatures of the at least three portions of the cylindrical wall near a setpoint temperature;

the controller being configured to operate the fan and at least three heaters in response to the first actuation vector and the second actuation vector.

17. A method for controlling the temperature of an image drum comprising:

generating a temperature signal corresponding to a temperature for at least three portions on a cylindrical wall, each temperature signal being measured by a different temperature sensor;

receiving the at least three temperature signals by a controller operatively connected to at least three heaters, each of which is configured to heat a portion of the cylindrical wall, and a fan configured to move air within the cylindrical wall; and the controller operating the fan and the at least three heaters to maintain a predetermined temperature for each portion of the cylindrical wall with reference to the signals generated by the at least three temperature sensors and image data used to operate at least one printhead that ejects melted solid ink onto the cylindrical wall.

18. The method of claim 17, the controller being further configured to operate the at least three heaters and the fan with reference to positions of pixels in the image data.

19. The method of claim 18, the controller being further configured to operate the at least three heaters and the fan with reference to positions of the pixels in the image data in the process direction.

20. The method of claim 18, the controller being further configured to operate the at least three heaters and the fan with reference to a number of pixels in the image data.

21. The method of claim 20, the controller being further configured to operate the at least three heaters and the fan with reference to the positions of the pixels in the image data in a process direction.

22. A controller for a printer comprising:

a feed-forward controller configured to receive image data from a printer and generate a first actuation vector configured with a first set of values to operate at least three heaters and a fan in an image drum in the printer to negate an effect on temperatures of at least three portions of a cylindrical wall of the image drum resulting from deposition of ink on the image drum corresponding to the image data; and a feedback controller configured to receive signals from at least three temperature sensors sensing temperatures of the at least three portions of the cylindrical wall and generate a second actuation vector configured with a second set of values to operate the at least three heaters and the fan to maintain the temperatures of the at least three portions of the cylindrical wall of the image drum near a setpoint temperature; and the controller being configured to operate the fan and the at least three heaters with reference to the first actuation vector and the second actuation vector.

23. The controller of claim 22, the feed-forward controller being further configured to generate the first actuation vector with reference to a number of pixels in the image data.

24. The controller of claim 22, the feed-forward controller being further configured to generate the first actuation vector with reference to positions of pixels in the image data.

25. The controller of claim 24, the feed-forward controller being further configured to generate the first actuation vector with reference to positions of pixels in the image data in a process direction only.

26. The controller of claim 25, the feed-forward controller being further configured to generate the first actuation vector with reference to a number of pixels in the image data.

* * * * *